US012571545B2

(12) United States Patent
Lu et al.

(10) Patent No.: US 12,571,545 B2
(45) Date of Patent: Mar. 10, 2026

(54) SPLIT WINDOW AIR CONDITIONER

(71) Applicant: Jiangsu Yoau Intelligent Technology Co., Ltd, Changzhou (CN)

(72) Inventors: Defeng Lu, Changzhou (CN); Xiaogang Yang, Changzhou (CN)

(73) Assignee: Jiangsu Yoau Intelligent Technology Co., Ltd, Changzhou (CN)

( * ) Notice: Subject to any disclaimer, the term of this patent is extended or adjusted under 35 U.S.C. 154(b) by 98 days.

(21) Appl. No.: 18/637,492

(22) Filed: Apr. 17, 2024

(65) Prior Publication Data

US 2025/0035322 A1 Jan. 30, 2025

(30) Foreign Application Priority Data

Jul. 27, 2023 (CN) ..... 202321999785.9

(51) Int. Cl.
*F24F 1/0003* (2019.01)

(52) U.S. Cl.
CPC ..... *F24F 1/0003* (2013.01); *F24F 2221/20* (2013.01)

(58) Field of Classification Search
CPC ..... F24F 1/0003; F24F 1/031; F24F 1/027; F24F 13/224; F24F 2221/20; F24F 1/32; F24F 2221/17
See application file for complete search history.

(56) References Cited

U.S. PATENT DOCUMENTS 2,362,698 A * 11/1944 Hull ..... F24F 1/60 62/262
2,500,852 A * 3/1950 Money ..... F24F 1/0003 62/262
2,760,354 A * 8/1956 Brady ..... F24F 1/04 62/448
3,176,474 A * 4/1965 Abbott ..... F24F 1/0003 62/262
3,392,546 A * 7/1968 Reed ..... F24F 7/013 62/262
3,611,743 A * 10/1971 Manganaro ..... F24F 13/22 62/297
5,167,131 A * 12/1992 Karkhanis ..... F24F 1/027 62/262
5,582,025 A * 12/1996 Dubin ..... F24F 13/32 62/262

(Continued)

FOREIGN PATENT DOCUMENTS

CN 114719334 A * 7/2022 ..... F24F 1/40
JP 60259844 A * 12/1985
WO WO-2005031218 A1 * 4/2005 ..... F24F 1/04

*Primary Examiner* — Nelson J Nieves
(74) *Attorney, Agent, or Firm* — Bayramoglu Law Offices

(57) ABSTRACT

A split window air conditioner is provided. The split window air conditioner includes an indoor unit, an outdoor unit, hoses, and a mounting frame, where a wire or pipe between the indoor unit and the outdoor unit passes through the hose; the indoor unit and the outdoor unit are provided on the mounting frame; and the mounting frame is provided with an accommodating groove for accommodating the hoses. The hoses accommodating wires or pipes between the indoor unit and the outdoor unit are accommodated in the accommodating groove. In this way, the wires or pipes between the indoor unit and the outdoor unit are protected from being compressed, excessively bent, or even broken.

8 Claims, 10 Drawing Sheets

(56) References Cited

U.S. PATENT DOCUMENTS

| | | | | |
|---|---|---|---|---|
| 6,568,201 | B1 * | 5/2003 | Cur | F24F 1/027 62/262 |
| 7,121,105 | B1 * | 10/2006 | Rais | F24F 1/027 62/262 |
| 7,992,404 | B2 * | 8/2011 | Su | F24F 1/027 62/262 |
| 10,156,369 | B2 * | 12/2018 | Booten | F24F 1/26 |
| 11,125,479 | B1 * | 9/2021 | Ingram | F25B 41/20 |
| 12,203,665 | B2 * | 1/2025 | Leezer | F24F 13/32 |
| 2009/0107162 | A1 * | 4/2009 | Su | F24F 13/32 62/263 |
| 2012/0318005 | A1 * | 12/2012 | Lingrey | F24F 1/20 62/77 |
| 2015/0192309 | A1 * | 7/2015 | Frolov | F24F 1/0003 62/262 |
| 2017/0284683 | A1 * | 10/2017 | Gallo | F24F 13/0245 |
| 2020/0088417 | A1 * | 3/2020 | Ingram | F24F 13/32 |
| 2020/0124296 | A1 * | 4/2020 | Baumann | F24F 1/027 |
| 2020/0370764 | A1 * | 11/2020 | Strickland | F24F 1/34 |
| 2021/0078118 | A1 * | 3/2021 | Li | F24F 1/031 |
| 2023/0003396 | A1 * | 1/2023 | Zemborain | F24F 1/32 |
| 2023/0126498 | A1 * | 4/2023 | Li | F24F 1/031 454/241 |
| 2025/0207788 | A1 * | 6/2025 | Kim | F24F 1/027 |

* cited by examiner

SPLIT WINDOW AIR CONDITIONER

CROSS-REFERENCE TO THE RELATED APPLICATIONS

This application is based upon and claims priority to Chinese Patent Application No. 202321999785.9, filed on Jul. 27, 2023, the entire contents of which are incorporated herein by reference.

TECHNICAL FIELD

The present disclosure relates to the technical field of air conditioners, and in particular, to a split window air conditioner.

BACKGROUND

In the prior art, the indoor unit and the outdoor unit of a window air conditioner are connected by a support. The components between the indoor unit and the outdoor unit, such as electric wire, refrigerant pipe, and water pipe, are usually randomly distributed without being limited, which can easily lead to twisting or bending of the pipes. If the connecting pipe is a plastic pipe, it is easily bent, broken, or compressed during mounting.

SUMMARY

In order to solve the problem of easy bending or even breakage of the pipe between the indoor unit and the outdoor unit of the window air conditioner in the prior art, the present disclosure provides a split window air conditioner that realizes accommodation and protection of the pipe.

In order to solve the above technical problems, the present disclosure adopts the following technical solution.

A split window air conditioner includes an indoor unit, an outdoor unit, hoses, and a mounting frame, where a wire or pipe between the indoor unit and the outdoor unit passes through the hose; the indoor unit and the outdoor unit are provided on the mounting frame; and the mounting frame is provided with an accommodating groove for accommodating the hoses.

Further, a cover plate above covers the accommodating groove. The cover plate restricts the movement of the hoses and provides protection for the hoses. The distance between the cover plate and the bottom of the accommodating groove is greater than the outer diameter of the hose to prevent it from being compressed. The outlet for the hoses extending from the cover plate is roughly located above the edge of the window sill, allowing the hoses to bend freely downwards.

Further, there are multiple hoses arranged side by side.

Further, a refrigerant pipe between the indoor unit and the outdoor unit includes a copper pipe joint and a bellows; and ends of the copper pipe joint and the bellows are welded.

Further, the accommodating groove is formed by bending a plate; the cover plate is surrounded by inner flanges; and the inner flange intersecting with the accommodating groove is provided with a secondary flange for avoiding the hose. The cover plate is formed by the flanges around, achieving simple processing and low cost.

Further, the mounting frame includes an internal support connected to the indoor unit; the indoor unit is fixedly provided with a detachable external support for mounting the outdoor unit; the internal support is provided with multiple first through-holes; the external support is provided with multiple second through-holes; the internal support and the external support are connected by a first bolt and a first nut; and the first bolt passes through the first through-hole and the second through-hole in sequence to cooperate with the first nut.

Further, the external support includes a vertical rod; the internal support is provided with a vertical flange; and a distance between the vertical rod and the vertical flange matches a thickness of a window sill.

Further, the mounting frame further includes a first fixing piece that is fixedly connected to the indoor unit; the internal support is provided with at least one first hanging hole; and the first fixing piece is provided with a first hook that hangs from the first hanging hole.

Further, the mounting frame further includes a second fixing piece that is fixedly connected to the outdoor unit; the external support is provided with multiple second hanging holes; the second fixing piece is provided with a second hook that hangs from the second hanging hole; and the second hanging holes are distributed at intervals in a vertical direction on the external support.

Further, the internal support is provided with a shock pad and welded with a fixing nut; the shock pad is connected to a stud that is threaded to the fixing nut; the internal support is further provided with a limiting pipe; the limiting pipe extends into a groove of a window and abuts against a side wall of the groove close to the external support; the limiting pipe is provided with a third through-hole; the internal support is provided with a fourth through-hole; the limiting pipe and the internal support are connected by a second bolt and a second nut; and the second bolt passes through the third through-hole and the fourth through-hole in sequence to cooperate with the second nut. In this way, the position of the limiting pipe is adjustable.

Beneficial Effects (1) In the present disclosure, the hoses accommodating wires or pipes between the indoor unit and the outdoor unit are accommodated in the accommodating groove. In this way, the wires or pipes between the indoor unit and the outdoor unit are protected from being compressed, excessively bent, or even broken.

(2) The cover plate limits and protects the hoses, and also serves as a support surface to support the up-and-down sliding window.

(3) The mounting frame has a split structure, including the internal support and the external support. The distance between the internal support and the external support is adjustable to adapt to window sills of different thicknesses.

(4) The indoor unit and the outdoor unit are provided on the mounting frame by hanging. A fastening device is provided under the indoor unit and the outdoor unit to ensure secure mounting, ease mounting, and save time.

(5) In the present disclosure, the refrigerant pipe uses a bellows, which features high flexibility and free bending, facilitating the mounting of users.

(6) The refrigerant pipe is formed by welding an outer copper joint to a stainless steel bellows. The production process is simple, and the material is simple and highly reliable. Stainless steel can withstand high temperatures without deformation, effectively avoiding leakage. In addition, the corrugated structural design ensures desired bending performance and toughness. Customers can be assured that there is no risk of hose ruptures for use in a long time.

BRIEF DESCRIPTION OF THE DRAWINGS

To describe the technical solutions in the embodiments of the present disclosure more clearly, the following briefly introduces the drawings required for describing the embodiments. Apparently, the drawings in the following description show merely some embodiments of the present disclosure, and those of ordinary skill in the art may still derive other drawings from these drawings without creative efforts.

Figure 1:
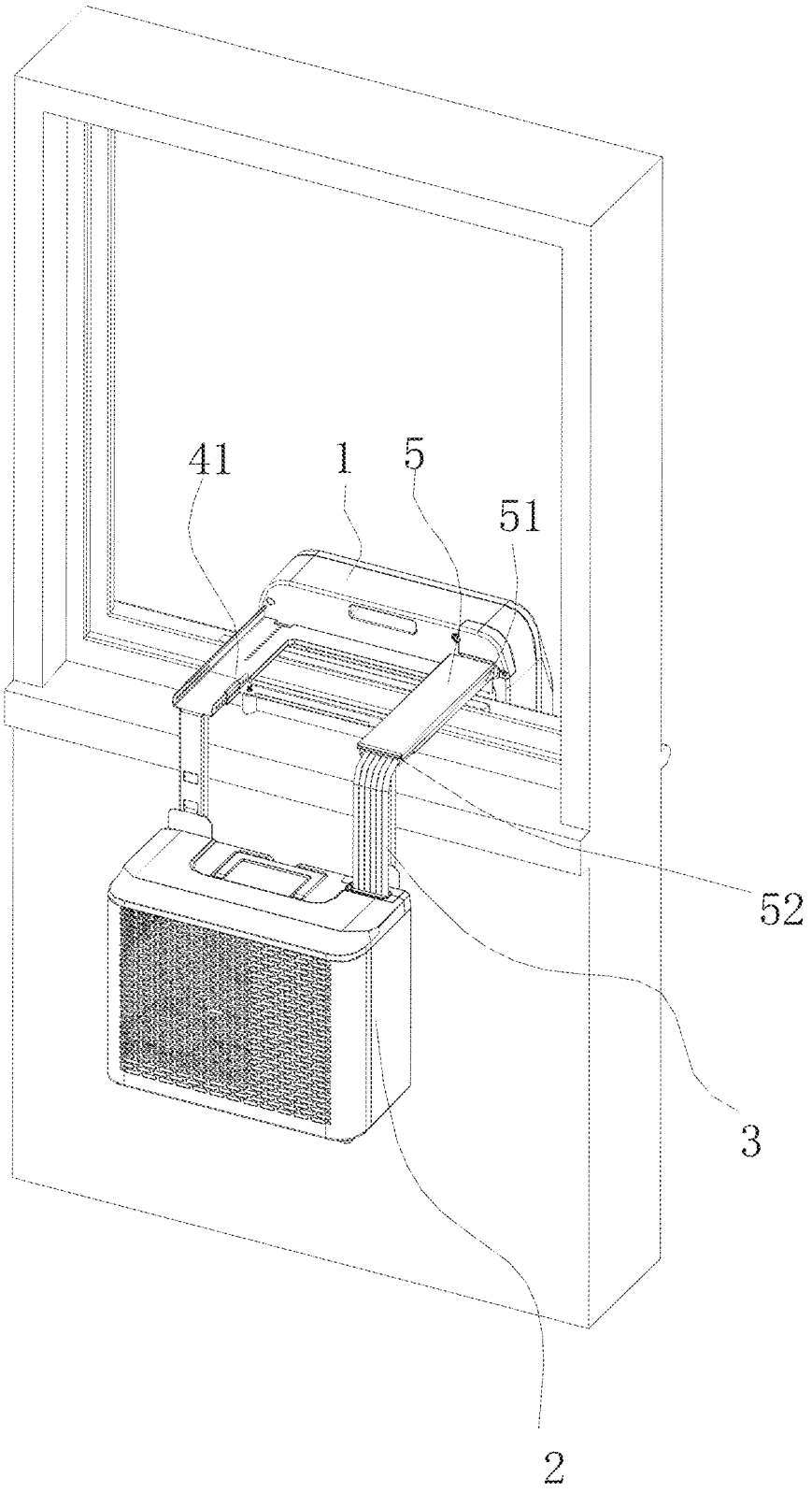
FIG. 1 is a schematic diagram of a split window air conditioner according to the present disclosure.
Figure 2:
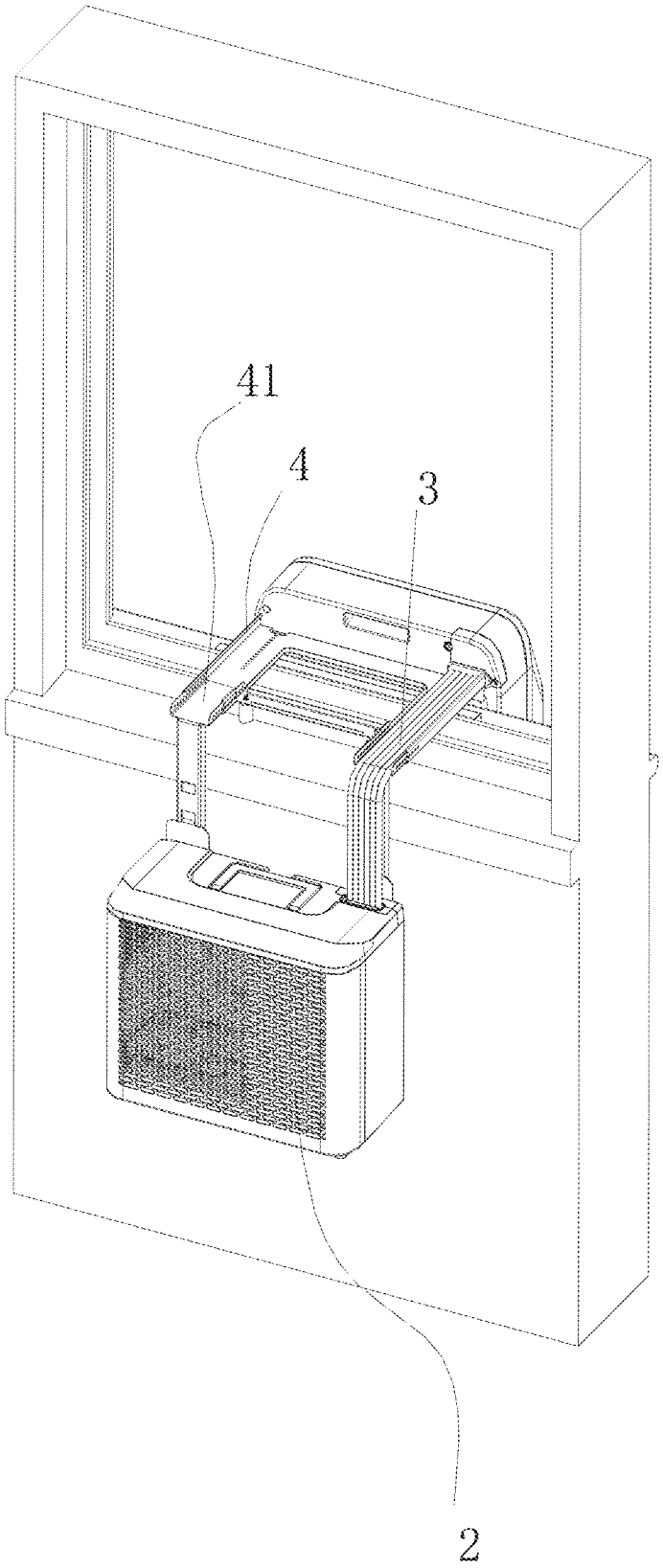
FIG. 2 is a schematic diagram of the split window air conditioner (with a cover plate not shown) according to the present disclosure.
Figure 3:
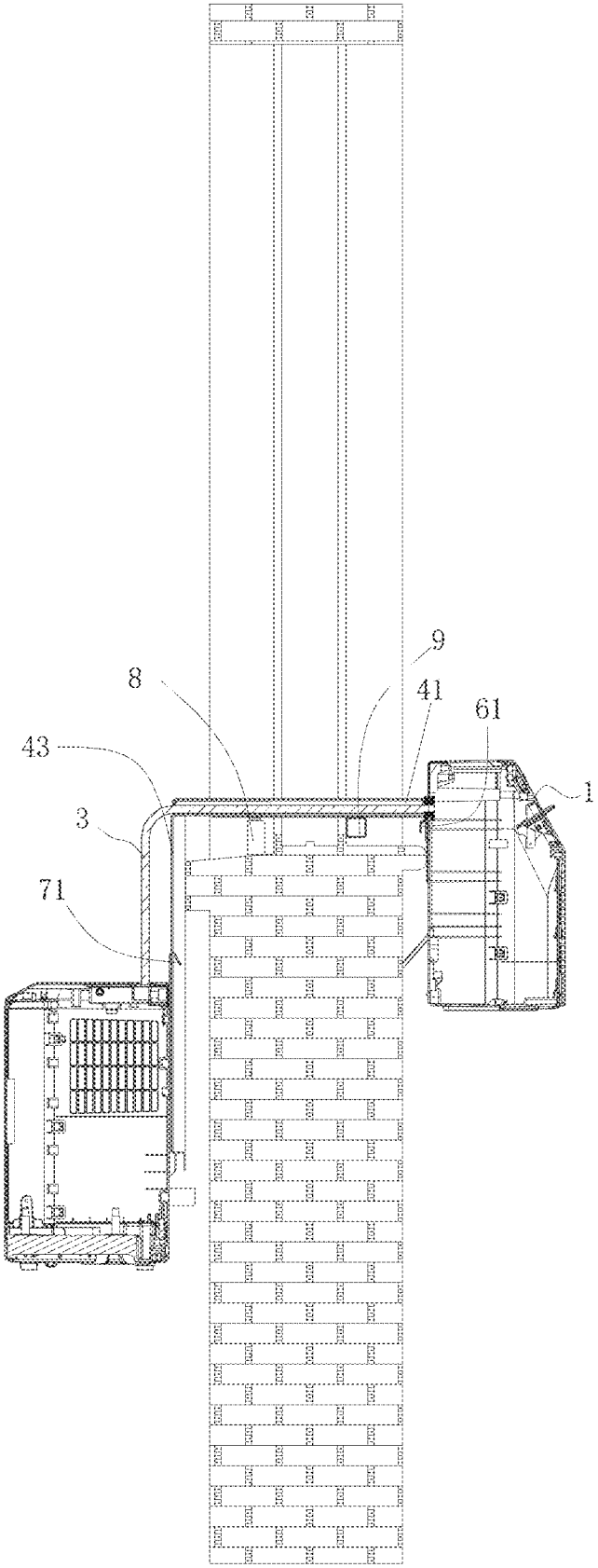
FIG. 3 is a sectional view of the split window air conditioner according to the present disclosure.
Figure 4:
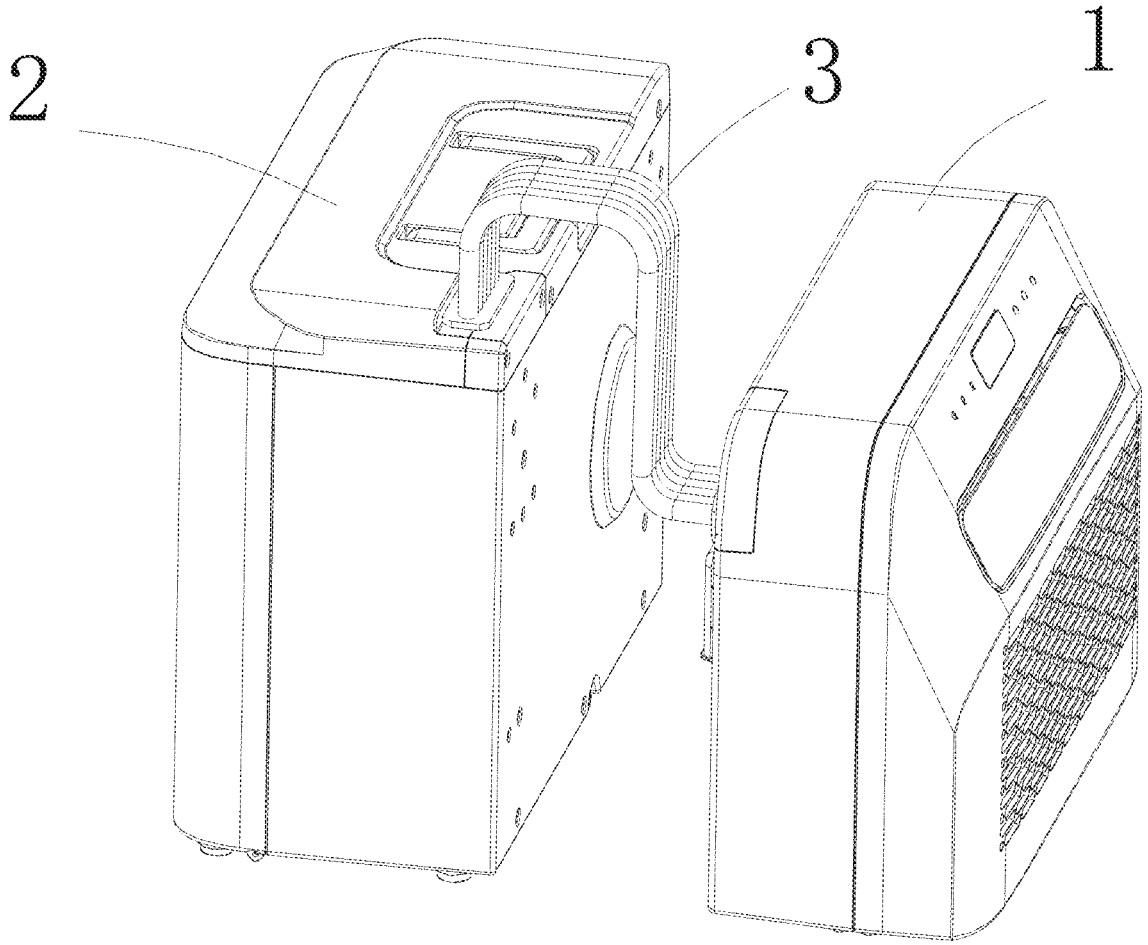
FIG. 4 is a schematic diagram of an indoor unit and an outdoor unit that are connected.
Figure 5:
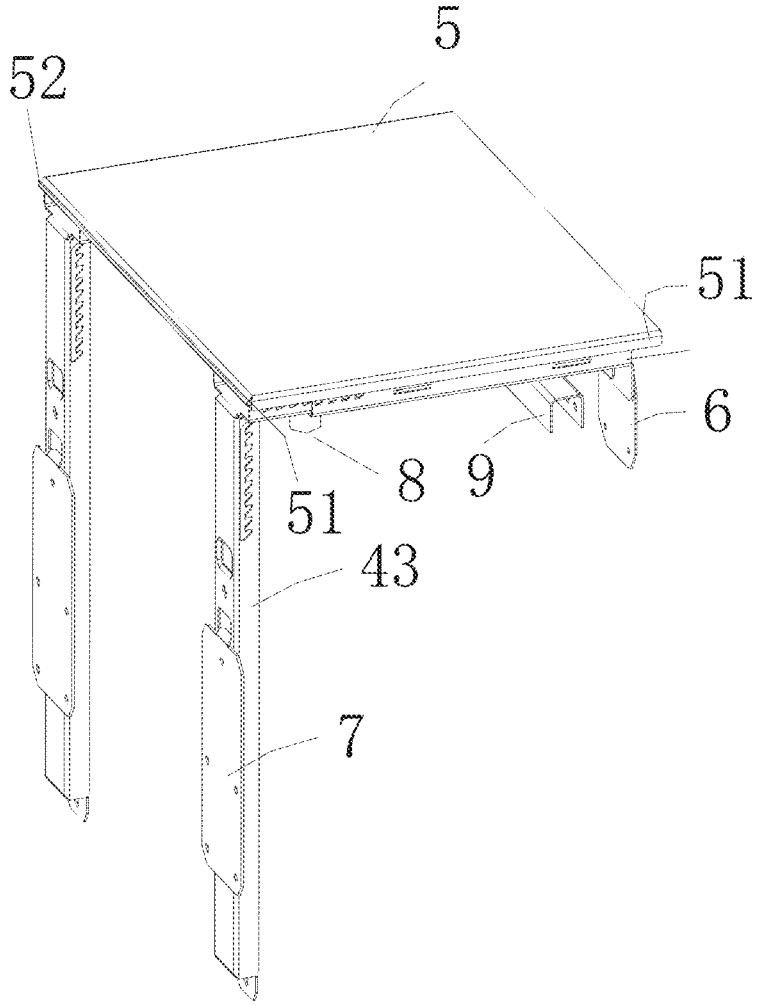
FIG. 5 is a schematic diagram of a mounting frame and a cover plate that cooperate with each other.
Figure 6:
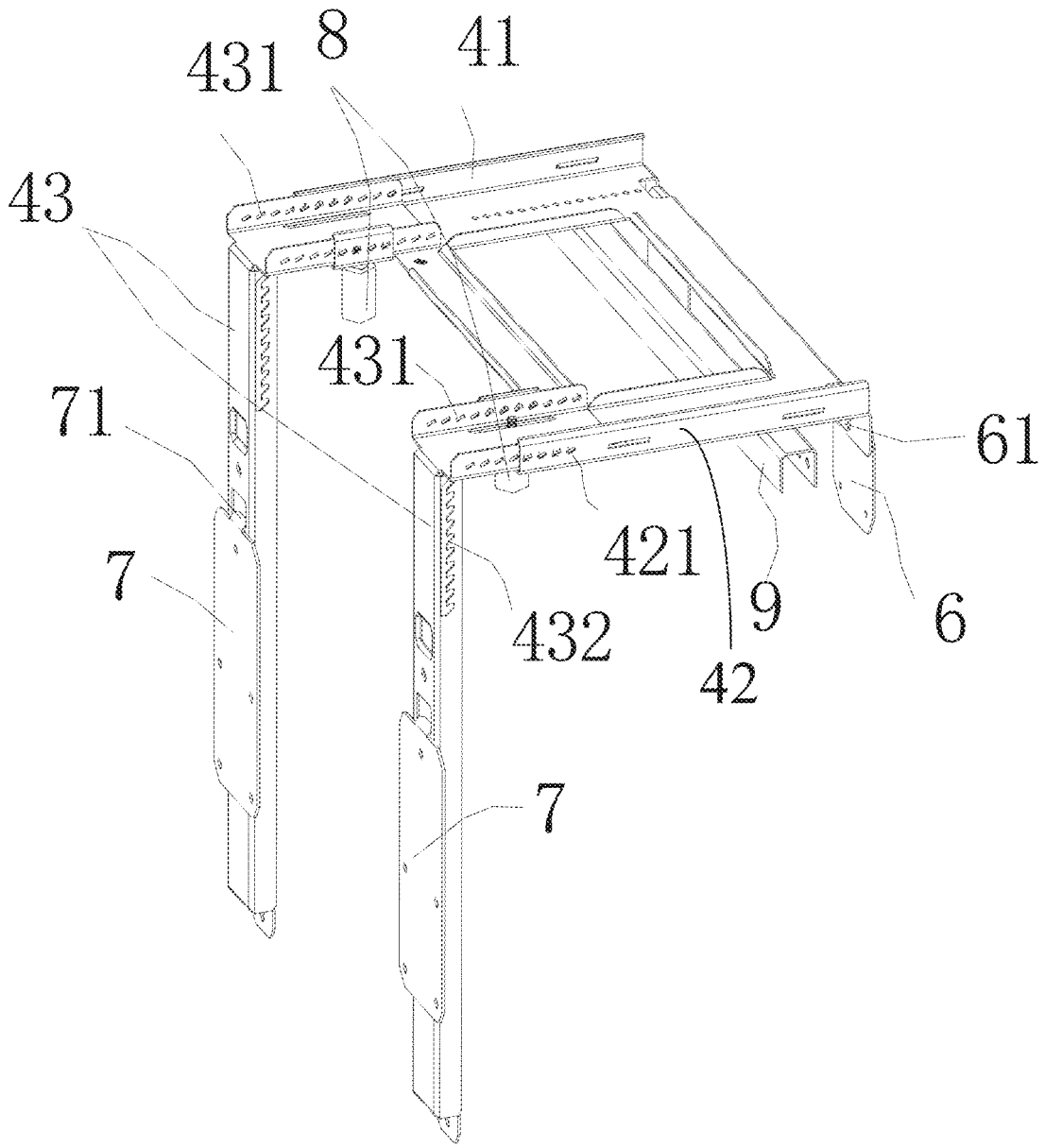
FIG. 6 is a structural diagram of the mounting frame.

Reference Numerals: 1. indoor unit; 2. outdoor unit; 3. hose; 4. mounting frame; 41. accommodating groove; 42. internal support; 421. first through-hole; 43. external support; 431. second through-hole; 432. weight reduction hole; 5. cover plate; 51 inner flange; 52. secondary flange; 6. first fixing piece; 61. first hook; 7. second fixing piece; 71. second hook; 8. shock pad; 9. limiting pipe; 10. refrigerant pipe; 101. copper pipe joint; 102. bellows; 11. electric wire harness; 12. water pipe; 13. copper pipe outer joint; 14. copper pipe inner joint; 15. copper sleeve; and 16, nylon connecting pipe.

DETAILED DESCRIPTION OF THE EMBODIMENTS

The technical solutions in embodiments of the present disclosure will be described below clearly and completely with reference to the accompanying drawings in the embodiments of the present disclosure. Apparently, the described embodiments are merely some, rather than all of the embodiments of the present disclosure. The following description of at least one exemplary embodiment is merely illustrative, and not intended to limit the present disclosure and application or use thereof in any way. All other embodiments obtained by those of ordinary skill in the art based on the embodiments of the present disclosure without creative efforts shall fall within the protection scope of the present disclosure.

It should be noted that the terminology used herein is for the purpose of describing particular embodiments only and is not intended to limit exemplary embodiments according to the present disclosure. As used herein, unless otherwise specified herein, the singular forms are also intended to include the plural forms. In addition, it should also be understood that when the terms "comprise" and/or "include" are used in this specification, they specify the presence of features, steps, operations, devices, components, and/or combinations thereof.

The relative arrangement of the components and steps, the numerical expressions and numerical values set forth in these embodiments do not limit the scope of the present disclosure unless specifically stated otherwise. Meanwhile, it should be understood that for ease of description, each portion in the drawings is not necessarily drawn to the actual scale. The technologies, methods, and devices known to those of ordinary skill in the art may not be discussed in detail, but where appropriate, the technologies, methods, and devices should be regarded as part of the specification. In all examples shown and discussed herein, any specific value should be interpreted as merely exemplary, rather than restrictive. Therefore, other examples of the exemplary embodiments may have different values. It should be noted that similar reference signs and letters represent similar items in the drawings below. Therefore, once an item is defined in one drawing, it does not need to be further discussed in subsequent drawings.

It should be understood that in the description of the present disclosure, orientation terms such as "front", "rear", "upper", "lower", "left", "right", "transverse", "longitudinal", "vertical", "horizontal", "top" and "bottom" indicate orientation or position relationships based on the drawings. Unless otherwise specified, these orientation terms are merely intended to facilitate or simplify the description of the present disclosure, rather than to indicate or imply that the mentioned device or elements must have a specific orientation and must be constructed and operated in a specific orientation. Therefore, they should not be construed as a limitation to the protection scope of the present disclosure. The orientation terms "inner" and "outer" refer to the inner and outer parts relative to the contour of the mentioned component.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

In addition, it should be noted that the use of words such as "first" and "second" to define parts and components is only for the convenience of distinguishing corresponding parts and components. Unless otherwise stated, the above words have no special meaning, so they should not be construed as a limitation on the protection scope of the present disclosure.

As shown in FIGS. 1 to 9, a split window air conditioner includes indoor unit 1, outdoor unit 2, hoses 3, and mounting frame 4. A wire or pipe between the indoor unit 1 and the outdoor unit 2 passes through the hose 3. The indoor unit 1 and the outdoor unit 2 are provided on the mounting frame 4. The mounting frame 4 is provided with accommodating groove 41 for accommodating the hoses. Cover plate 5 above covers the accommodating groove 41. There are multiple hoses 3 arranged side by side. The accommodating groove 41 is formed by bending a plate. The cover plate 5 is surrounded by inner flanges 51, and the inner flange 51 intersecting with the accommodating groove 41 is provided with secondary flange 52 for avoiding the hose.

Figure 10:
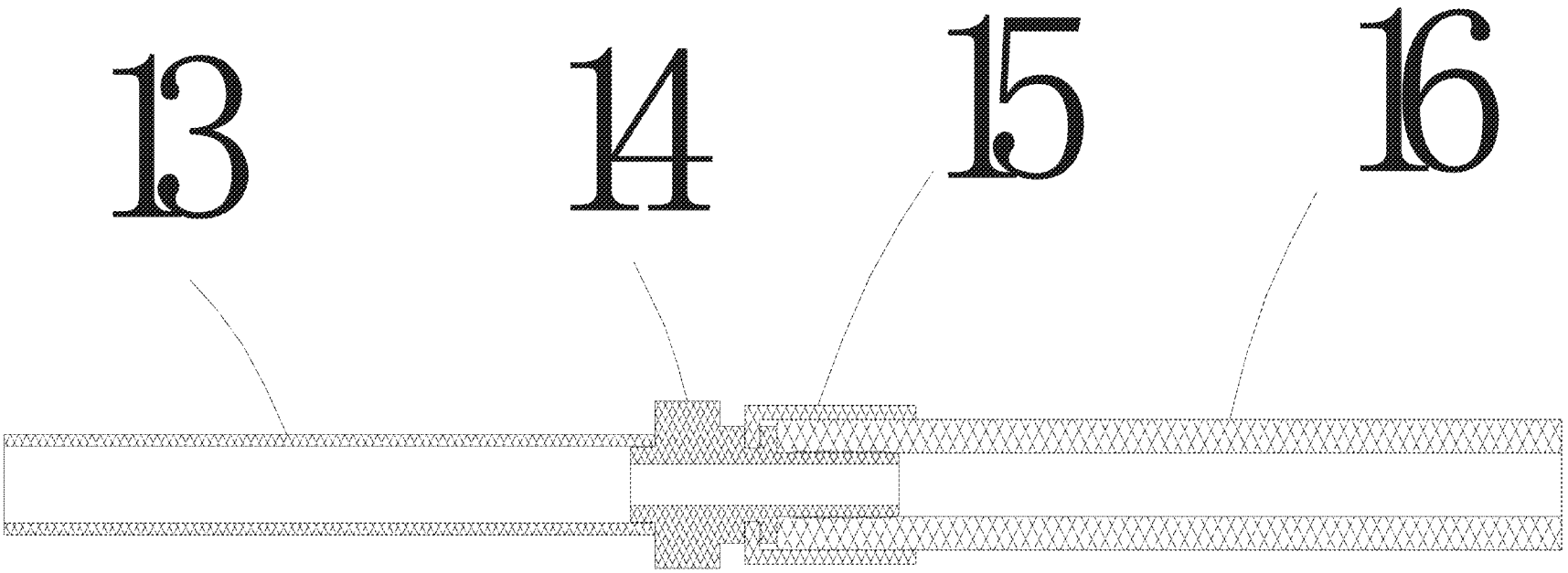
FIG. 10 is a structural diagram of a refrigerant pipe in a prior art.

Refrigerant pipe 10 is provided between the indoor unit 1 and the outdoor unit 2 to transport a refrigerant. Traditional connecting hoses are usually made of plastic such as nylon, as shown in FIG. 10. During production, copper pipe outer joint 13 and inner joint 14 of the copper pipe are first welded, and then the nylon connecting pipe 16 is connected by sheathing with copper sleeve 15. This design has the following drawbacks. Nylon has low toughness and is not easy to bend, so if the hose is excessively bent, it will break and deform. The overall production process of the hose is complex and costly. In addition, in the production of the complete machine, the outer joint of the hose needs to be welded to the evaporator and condenser. Due to the high welding temperature, the internal temperature of the hose will rise rapidly, causing the nylon connecting pipe to easily deform due to heat, thereby resulting in leakage. Therefore, during welding, it is necessary to manually cool the connecting pipe by dripping water, which causes inconvenience to customers' production.

In addition, traditional smooth connecting pipes are not easy to bend during mounting, with low toughness and small bending radius, making them easily break and compress due to large external forces. Increasing the toughness requires reduction in the hardness of the hose, but this can also cause the connector to leak easily.

Figure 7:
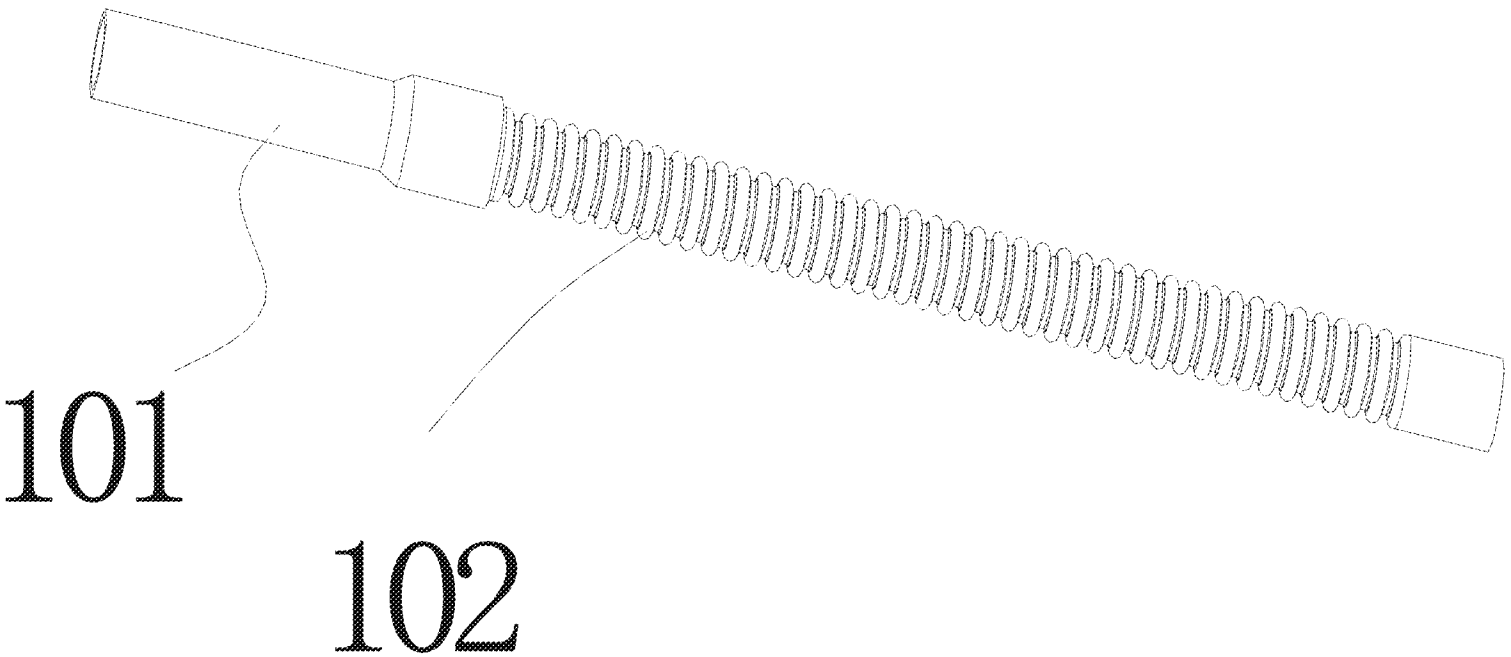
FIG. 7 is a structural diagram of a refrigerant pipe.
Figure 8:
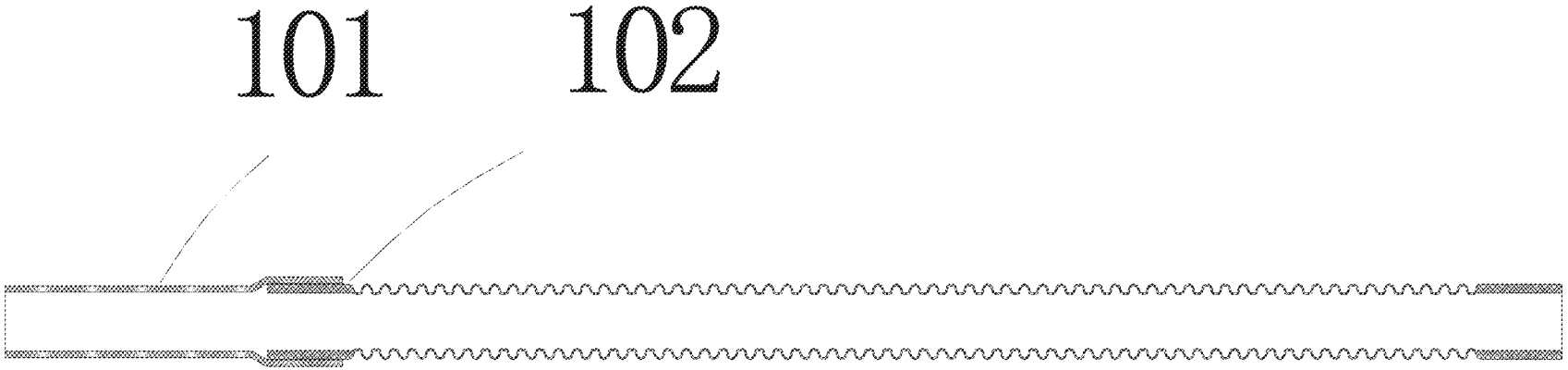
FIG. 8 is a sectional view of the refrigerant pipe.
Figure 9:
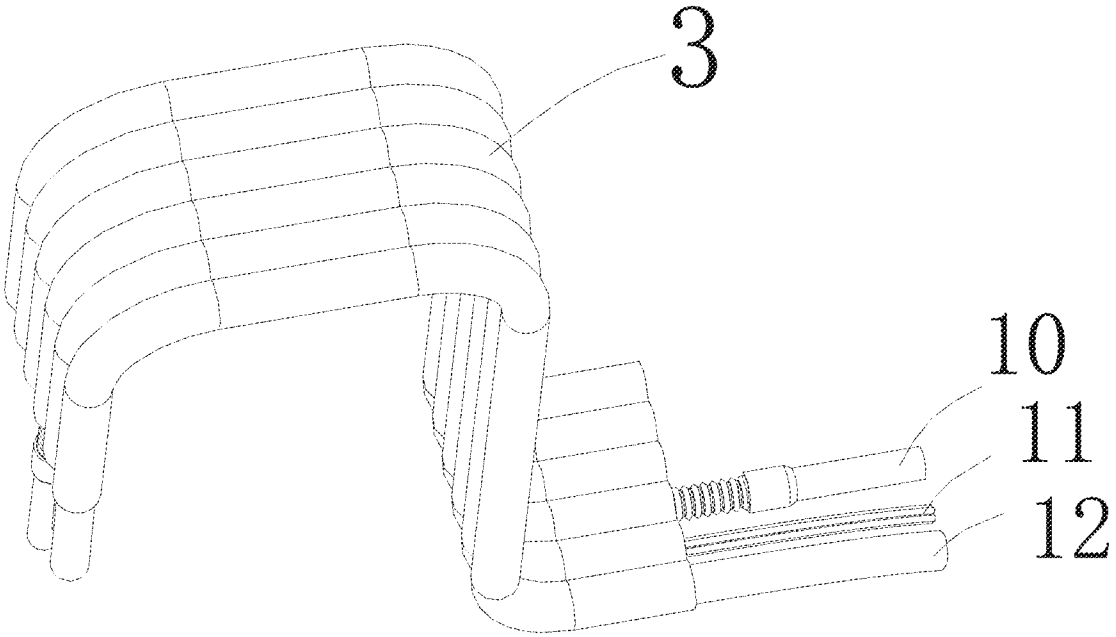
FIG. 9 is a schematic diagram of hoses, a refrigerant pipe, an electric wire harness, and a water pipe.

As shown in FIGS. 7 and 8, in the present disclosure, the refrigerant pipe 10 between the indoor unit 1 and the outdoor unit 2 includes copper pipe joint 101 and bellows 102. The bellows 102 can be made of stainless steel. The ends of the copper pipe joint 101 and the bellows 102 are welded. The production process is simple, and the material is simple and highly reliable. Stainless steel can withstand high temperatures without deformation, effectively avoiding leakage. In addition, the corrugated structural design ensures desired bending performance and toughness. Customers can be assured that there is no risk of hose ruptures for use in a long time.

The bellows 102 can also be made of nylon or Teflon for the refrigerant transport of the split mobile air conditioner. The structure of the bellows 102 avoids the traditional form of smooth connecting pipe. The bellows 102 solves the drawbacks of smooth connecting pipes. The bellows 102 features high flexibility, free bending, and easy mounting for users. It can be made of materials with high hardness, greatly increasing the compressive resistance.

The mounting frame 4 includes an internal support 42 connected to the indoor unit 1. The indoor unit 1 can also be fixed to an interior wall through an additional pipe fitting. The internal support 42 is fixedly provided with detachable external support 43 for mounting the outdoor unit 2. The internal support 42 and the external support 43 can be fixed by clamping, welding, or other means. Preferably, in order to adjust a distance between the internal support 42 and the external support 43, the internal support 42 is provided with multiple first through-holes 421, and the external support 43 is provided with multiple second through-holes 431. The internal support 42 and the external support 43 are connected by a first bolt and a first nut. The first bolt passes through the first through-hole 421 and the second through-hole 431 in sequence to cooperate with the first nut. The external support 43 is formed by bending a rod into a horizontal rod and a vertical rod. The horizontal rod of the external support 43 is provided with an upper flange to form the accommodating groove 41 for accommodating the hoses. A side of the vertical rod of the external support close to a window sill is provided with a side flange that abuts against the window sill and is provided with weight reduction hole 432.

The internal support 42 includes a horizontal section and a vertical flange that is provided at an end of the horizontal section. A distance between the vertical rod (edge of the side flange) and the vertical flange matches a thickness of the window sill. The horizontal section is also provided with an upper flange. The first through-holes 421 are provided on the upper flange of the internal support 42, and the second through-holes 431 are provided on the upper flange of the external support 43. The internal support 42 and the external support 43 share an overlapping section. After the first through-hole 421 and the second through-hole 431 are aligned, they are fixed by the first bolt and the first nut. The mounting frame 4 further includes first fixing piece 6 that is fixedly connected to the indoor unit. The internal support 42 is provided with at least one first hanging hole. The first fixing piece 6 is provided with first hook 61 that hangs from the first hanging hole. The indoor unit 1 can be fixed to a connecting rod, and the connecting rod is fixed to the interior wall.

The mounting frame 4 further includes second fixing piece 7 that is fixedly connected to the outdoor unit 2. The external support is provided with multiple second hanging holes. The second fixing piece 7 is provided with second hook 71 that hangs from the second hanging hole. The second hanging holes are distributed at intervals in a vertical direction on the external support 43. In order to ensure the firm mounting of the outdoor unit, the external support 43 is connected to the outdoor unit by a fastening screw. A bottom end of the external support 43 can be provided with a fixing hole. The fastening screw passes through the fixing hole to be connected to the outdoor unit.

The internal support 42 is provided with shock pad 8. A fixing nut is embedded and welded with the internal support 42. The shock pad 8 is connected to a stud, and the stud is threaded to the fixing nut.

The internal support 42 is further provided with limiting pipe 9. The limiting pipe 9 extends into a groove of a window and abuts against a side wall of the groove close to the external support 43. The limiting pipe 9 is provided with a third through-hole. The internal support 42 is provided with a fourth through-hole. The limiting pipe 9 and the internal support 42 are connected by a second bolt and a second nut. The second bolt passes through the third through-hole and the fourth through-hole in sequence to cooperate with the second nut.

The above merely describes specific implementations of the present disclosure, but the protection scope of the present disclosure is not limited thereto. Those skilled in the art can easily conceive modifications or replacements according to the technical solutions and ideas of the present disclosure within the technical scope of the present disclosure, and these modifications or replacements shall fall within the protection scope of the present disclosure.

What is claimed is:

1. A split window air conditioner, comprising an indoor unit, an outdoor unit, hoses, and a mounting frame, wherein a wire or pipe between the indoor unit and the outdoor unit passes through the hoses; the indoor unit and the outdoor unit are provided on the mounting frame; and the mounting frame is provided with an accommodating groove for accommodating the hoses; wherein the mounting frame comprises an internal support connected to the indoor unit;

the internal support is fixedly provided with a detachable external support for mounting the outdoor unit;

the internal support is provided with a plurality of first through-holes; and the external support is provided with a plurality of second through-holes;

wherein the external support comprises a vertical rod; the internal support is provided with a vertical flange; and a distance between the vertical rod and the vertical flange matches a thickness of a window sill.

2. The split window air conditioner according to claim 1, wherein a cover plate above covers the accommodating groove.

3. The split window air conditioner according to claim 1, wherein the hoses are arranged side by side.

4. The split window air conditioner according to claim 1, wherein a refrigerant pipe between the indoor unit and the outdoor unit comprises a copper pipe joint and a bellows; and ends of the copper pipe joint and the bellows are welded.

5. The split window air conditioner according to claim 2, wherein the accommodating groove is formed by bending a plate; and the cover plate is surrounded by inner flanges.

6. The split window air conditioner according to claim 1, wherein the mounting frame further comprises a first fixing piece, the first fixing piece is fixedly connected to the indoor unit; the internal support is provided with at least one first hanging hole; and the first fixing piece is provided with a first hook, the first hook hangs from the at least one first hanging hole.

7. The split window air conditioner according to claim 6, wherein the mounting frame further comprises a second fixing piece, the second fixing piece is fixedly connected to the outdoor unit; the external support is provided with a plurality of second hanging holes; the second fixing piece is provided with a second hook, the second hook hangs from the second hanging hole; and the plurality of second hanging holes are distributed at intervals in a vertical direction on the external support.

8. The split window air conditioner according to claim 1, wherein the internal support is provided with a shock pad and welded with a fixing nut;

the shock pad is connected to a stud, the stud is threaded to the fixing nut;

the internal support is further provided with a limiting pipe;

the limiting pipe extends into a groove of a window and abuts against a side wall of the groove adjacent to the external support;

the limiting pipe is provided with a third through-hole;

the internal support is provided with a fourth through-hole;

the limiting pipe and the internal support are connected by a second bolt and a second nut; and the second bolt passes through the third through-hole and the fourth through-hole in sequence to cooperate with the second nut.

* * * * *